US010017342B2

(12) United States Patent
Okutsu et al.

(10) Patent No.: US 10,017,342 B2
(45) Date of Patent: Jul. 10, 2018

(54) PAPER SHEET CONVEYANCE DEVICE AND IMAGE FORMING APPARATUS

(71) Applicants: Toshihiro Okutsu, Kanagawa (JP); Masaki Ishizaki, Kanagawa (JP); Yasuo Niikura, Kanagawa (JP); Hidetoshi Kojima, Kanagawa (JP); Masato Hashimoto, Kanagawa (JP); Munehisa Fuda, Kanagawa (JP); Tatsuya Sugawara, Kanagawa (JP); Kohjiroh Haga, Kanagawa (JP); Kiyotake Nakamura, Kanagawa (JP); Hideaki Takahashi, Kanagawa (JP); Takashi Fukumoto, Kanagawa (JP)

(72) Inventors: Toshihiro Okutsu, Kanagawa (JP); Masaki Ishizaki, Kanagawa (JP); Yasuo Niikura, Kanagawa (JP); Hidetoshi Kojima, Kanagawa (JP); Masato Hashimoto, Kanagawa (JP); Munehisa Fuda, Kanagawa (JP); Tatsuya Sugawara, Kanagawa (JP); Kohjiroh Haga, Kanagawa (JP); Kiyotake Nakamura, Kanagawa (JP); Hideaki Takahashi, Kanagawa (JP); Takashi Fukumoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/060,671

(22) Filed: Mar. 4, 2016

(65) Prior Publication Data

US 2016/0264370 A1 Sep. 15, 2016

(30) Foreign Application Priority Data

Mar. 13, 2015 (JP) ..... 2015-050357

(51) Int. Cl.
*B65H 7/02* (2006.01)
*B65H 5/06* (2006.01)
(Continued)

(52) U.S. Cl.
CPC ..... *B65H 5/062* (2013.01); *B65H 7/02* (2013.01); *G03G 15/6529* (2013.01);
(Continued)

(58) Field of Classification Search
CPC ..... B65H 2301/4452; B65H 7/02; G03G 15/6564
See application file for complete search history.

(56) References Cited

U.S. PATENT DOCUMENTS

2008/0297580 A1 12/2008 Fukumoto et al.
2009/0014948 A1 1/2009 Takahashi
(Continued)

FOREIGN PATENT DOCUMENTS

JP 09-030684 2/1997
JP 2012-180189 9/2012

*Primary Examiner* — Howard J Sanders
(74) *Attorney, Agent, or Firm* — Harness, Dickey & Pierce, P.L.C.

(57) ABSTRACT

A paper sheet conveyance device includes a plurality of conveyance members and conveys a paper sheet while performing temporary stop of conveying and then restart of conveying. Two paper sheets sequential in a conveyance direction stop together in a state of the temporary stop, driving a first transfer member to which a preceding first paper sheet that is one of the two paper sheets is opposed and a second conveyance member to which a following second paper sheet that is the other paper sheet is opposed is stopped and restarted synchronously for the temporary stop and the restart. A stop position information acquisition unit acquires information on a position on the conveyance path at which the second paper sheet stops in the state of the temporary stop, and a timing for stopping the conveying after the
(Continued)

conveying is restarted is controlled according to the acquired information.

17 Claims, 5 Drawing Sheets

(51) Int. Cl.
*G03G 15/00* (2006.01)
*G03G 21/14* (2006.01)

(52) U.S. Cl.
CPC ..... *G03G 15/6564* (2013.01); *G03G 21/14* (2013.01); *B65H 2301/4452* (2013.01); *B65H 2511/20* (2013.01); *B65H 2513/50* (2013.01); *B65H 2701/1311* (2013.01)

(56) References Cited

U.S. PATENT DOCUMENTS

| | | | | |
|---|---|---|---|---|
| 2011/0148027 | A1 | 6/2011 | Fuda | |
| 2011/0187042 | A1 | 8/2011 | Fuda | |
| 2011/0187044 | A1 | 8/2011 | Utagawa et al. | |
| 2011/0193284 | A1 | 8/2011 | Fuda | |
| 2011/0221119 | A1 | 9/2011 | Fuda | |
| 2011/0286828 | A1* | 11/2011 | Iwata ..... | B65H 29/6645 414/789.9 |
| 2012/0133092 | A1 | 5/2012 | Fuda et al. | |
| 2012/0313315 | A1 | 12/2012 | Fukumoto et al. | |
| 2013/0062827 | A1 | 3/2013 | Fuda | |
| 2013/0087967 | A1 | 4/2013 | Fuda et al. | |
| 2013/0106045 | A1 | 5/2013 | Okutsu et al. | |
| 2013/0334764 | A1 | 12/2013 | Fuda | |
| 2014/0339759 | A1 | 11/2014 | Takahashi et al. | |
| 2014/0339761 | A1 | 11/2014 | Oikawa et al. | |
| 2014/0346728 | A1 | 11/2014 | Fuda et al. | |

* cited by examiner

PAPER SHEET CONVEYANCE DEVICE AND IMAGE FORMING APPARATUS

CROSS-REFERENCE TO RELATED APPLICATIONS

The present application claims priority to and incorporates by reference the entire contents of Japanese Patent Application No. 2015-050357 filed in Japan on Mar. 13, 2015.

BACKGROUND OF THE INVENTION

1. Field of the Invention

The present invention relates generally to a paper sheet conveyance device and an image forming apparatus.

2. Description of the Related Art

A conveyance member (conveyance roller) that conveys a paper sheet is known as a paper sheet conveyance device that is used for, for example, an image forming apparatus.

Japanese Laid-open Patent Publication No. 2012-180189 describes that, in a paper sheet conveyance device, when the interval between a preceding paper sheet and a paper sheet following the preceding paper sheet is narrower than a specific distance while paper sheets are sequentially conveyed, the interval is corrected to the certain distance. Specifically, the actual interval between the preceding paper sheet and the following paper sheet is calculated by using the difference between the time point at which a paper sheet back end sensor detects the back end of the preceding paper sheet and the time point at which the paper sheet back end sensor detects the back end of the following paper sheet. When the calculated actual distance is shorter than the specific distance, while a conveyance roller that is conveying the preceding paper sheet is being driven, only a conveyance roller that is conveying the following paper sheet is stopped. In this manner, when the interval between the preceding paper sheet and the following paper sheet is shorter than the specific distance, the interval can be corrected to the specific distance. This prevents the paper sheets being conveyed from overlapping each other and from being jammed due to the too short interval between the preceding paper sheet and the following paper sheet.

In order to stop only the conveyance roller that is conveying the following paper sheet while the conveyance roller that is conveying the preceding paper sheet is being driven, the paper sheet conveyance device described in Japanese Laid-open Patent Publication No. 2012-180189 has to be configured to separately drive and stop the conveyance roller that is conveying the preceding paper sheet and the conveyance roller that is conveying the following paper sheet. Separately driving and stopping the conveyance roller that is conveying the preceding paper sheet and the conveyance roller that is conveying the following paper sheet requires complicated control for driving and stopping the conveyance rollers, which may increase the cost of the device.

SUMMARY OF THE INVENTION

It is an object of the present invention to at least partially solve the problems in the conventional technology.

According to an aspect of the present invention, there is provided a paper sheet conveyance device including a plurality of conveyance members that are disposed along a conveyance path for paper sheet and that are driven in order to convey a paper sheet, and conveying the paper sheet while performing temporary stop of conveying the paper sheet and then restart of conveying the paper sheet, wherein two paper sheets sequential in a conveyance direction stop together in a state of the temporary stop of conveying, driving a first transfer member to which a preceding first paper sheet that is one of the two paper sheets is opposed and a second conveyance member to which a following second paper sheet that is the other paper sheet is opposed is stopped and restarted synchronously for the temporary stop of conveying and the restart of conveying, a stop position information acquisition unit acquires information on a position on the conveyance path at which the second paper sheet stops in the state of the temporary stop of conveying, and a timing for stopping the conveying after the conveying is restarted is controlled according to the information acquired by the stop position information acquisition unit.

According to another aspect of the present invention, there is provided an image forming apparatus including: an image forming unit that forms an image on a paper sheet; and a paper sheet conveyance device including a plurality of conveyance members that are disposed along a conveyance path for paper sheet and that are driven in order to convey a paper sheet, and conveying the paper sheet while performing temporary stop of conveying the paper sheet and then restart of conveying the paper sheet, wherein two paper sheets sequential in a conveyance direction stop together in a state of the temporary stop of conveying, driving a first transfer member to which a preceding first paper sheet that is one of the two paper sheets is opposed and a second conveyance member to which a following second paper sheet that is the other paper sheet is opposed is stopped and restarted synchronously for the temporary stop of conveying and the restart of conveying, a stop position information acquisition unit acquires information on a position on the conveyance path at which the second paper sheet stops in the state of the temporary stop of conveying, and a timing for stopping the conveying after the conveying is restarted is controlled according to the information acquired by the stop position information acquisition unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention in which the present invention is applied to an electrophotographic printer (hereinafter, simply "printer") serving as an image forming apparatus will be described below.

A paper sheet conveyance device according to the embodiments includes a plurality of conveyance rollers that are disposed along a conveyance path for paper sheet and that are driven in order to convey the paper sheet. The conveyance rollers between a downstream-side position and an upstream-side position that are predetermined positions on a downstream side and an upstream side of the conveyance path for paper sheet in a conveyance direction for paper sheet are driven and stopped synchronously, and driving and stopping the conveyance roller on the upstream side with respect to the upstream-side position can be controlled separately from driving and stopping the conveyance rollers. The paper sheet conveyance device includes a control unit that controls driving the conveyance rollers such that the paper sheets between the downstream-side position and the upstream-side position are stopped at a given stop timing and conveying the paper sheets is restarted at a given conveyance restart timing; a paper sheet leading edge detection sensor that is disposed at the downstream-side position and that detects the leading edge of the paper sheet in the conveyance direction; and a time measuring unit that measures the required paper sheet move time from when the conveying is restarted at the given conveyance restart timing until when the paper sheet leading edge detection sensor detects the leading edge of the paper sheet following the top paper sheet in the conveyance direction from among the paper sheets. The conveyance rollers are configured such that, when the paper sheets are stopped at a given stop timing, the top paper sheet overlaps the conveyance roller on the downstream side from among the conveyance rollers and the paper sheet following the top paper sheet overlaps the conveyance roller on the upstream side from among the conveyance rollers. The control unit determines the stop timing according to the paper sheet move time.

Figure 1:
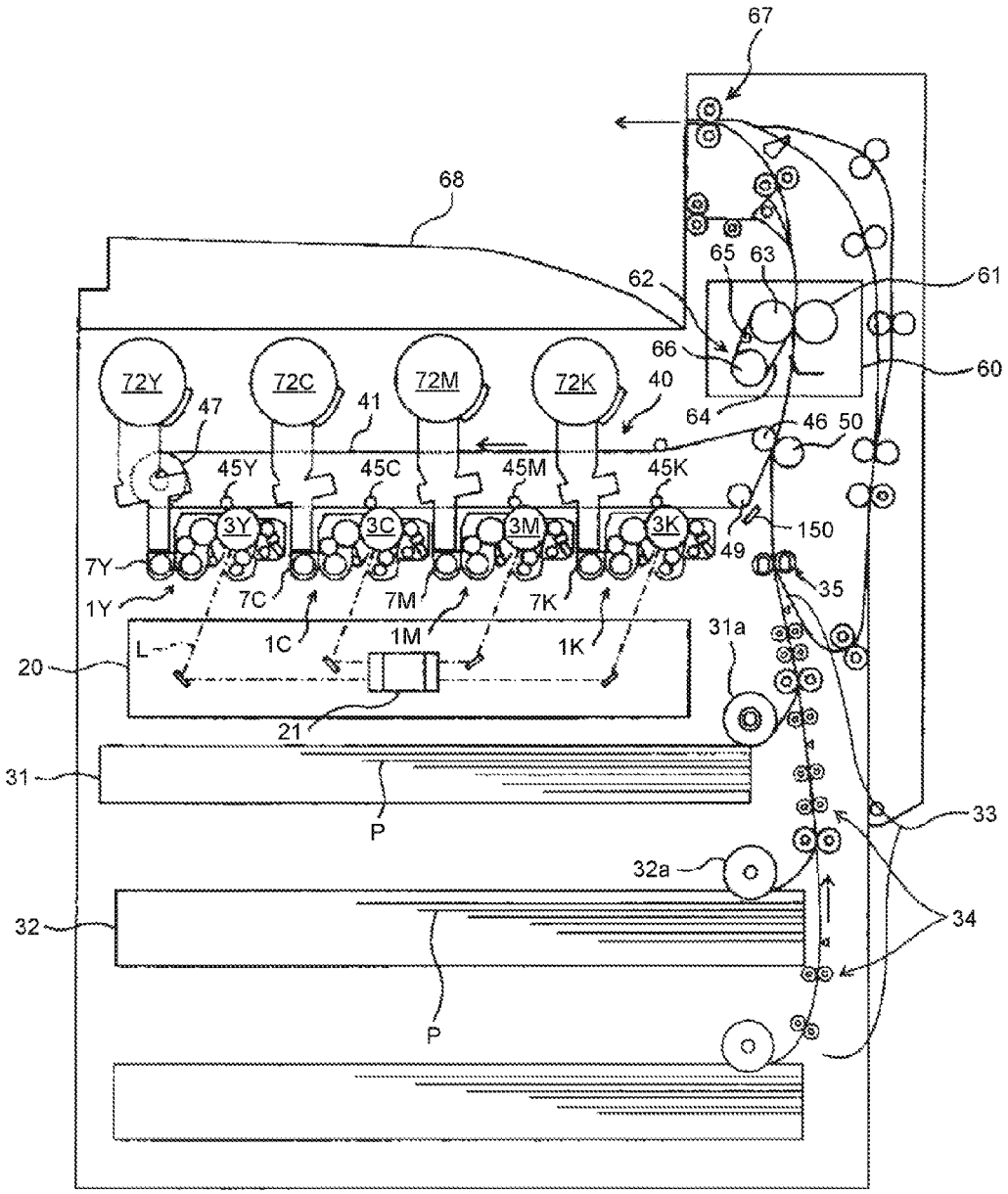
FIG. 1 is a schematic configuration diagram of a printer according to an embodiment of the present invention.

First, the basic configuration of the printer according to the embodiment will be described. FIG. 1 is a schematic configuration diagram of the printer according to the embodiment. The printer includes four image formation units 1Y, 1C, 1M and 1K for yellow, cyan, magenta and black (hereinafter, "Y, C, M and K"). The image formation units have the same configuration except that the image formation units respectively use Y, C, M and K toners whose colors are different from one another as image forming substances for forming images.

Figure 2:
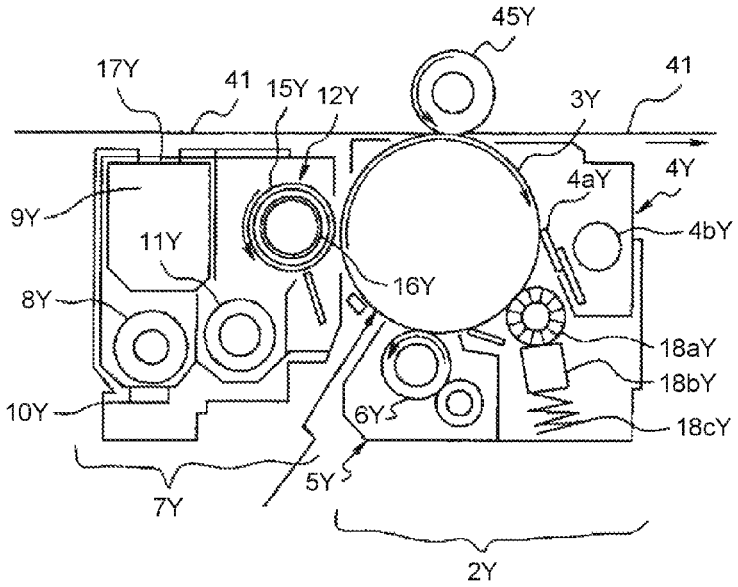
FIG. 2 is a schematic configuration diagram of an image formation unit of the printer.

FIG. 2 is a schematic configuration diagram of an image formation unit 1Y for forming a Y toner image. The image formation unit 1Y includes a photoconductor unit 2Y and a developing unit 7Y. The photoconductor unit 2Y and the developing unit 7Y are configured to integrally serve as the image formation unit 1Y attachable/detachable with respect to the printer main unit. However, in the state of being detached from the printer main unit, the developing unit 7Y is attachable/detachable with respect to a photoconductor unit (not shown).

The photoconductor unit 2Y includes a photoconductor 3Y serving as a latent image bearer and having a drum-like shape, a drum cleaning device 4Y, a neutralization unit (not shown), a charging device 5Y, and a lubricant application device 18Y. By using a charging roller 6Y, the charging device 5Y serving as a charging unit uniformly uniformly charges the surface of the photoconductor 3Y that is being driven by a drive unit (not shown) to rotate clockwise as shown in FIG. 2. Specifically, as shown in FIG. 2, the photoconductor 3Y is uniformly charged by applying a charging bias from a power supply (not shown) to the charging roller 6Y that is driven to rate counterclockwise and by causing the charging roller 6Y to be close to or touch the photoconductor 3Y.

Instead of the charging roller 6Y, a unit that causes another charging member, such as a charging brush, to be close to or touch the photoconductor 3Y may be used. Furthermore, a unit, such as a scorotron charger, that uniformly charges the photoconductor 3Y by using a charger technique may be used. The surface of the photoconductor 3Y that is uniformly charged by the charging device 5Y is scanned by exposure with a laser light emitted from an optical writing unit 20 serving as a latent image formation unit, which will be described below, so that the surface of the photoconductor 3Y bears the electrostatic latent image for Y.

The developing unit 7Y includes: a first agent container 9Y in which a first conveyance screw 8Y serving as a developer conveyance unit is disposed; and a toner concentration sensor 10Y serving as a toner concentration detection unit and composed of a magnetic permeability sensor. The developing unit 7Y further includes a second agent container 14Y in which a second conveyance screw 11Y serving as a developer conveyance unit, a developing roller 12Y serving as a developer bearer, and a doctor blade 13Y serving as a developer regulation unit are disposed.

These two agent containers that form a circulation path contain a Y developer (not shown) that is a two-component developer composed of a magnetic carrier and a negative charge Y toner. The first conveyance screw 8Y is driven by a drive unit (not shown) to rotate, thereby conveying the Y developer in the first agent container 9Y from the back side to the front side in the direction orthogonal to the surface of the drawing of FIG. 2. The toner concentration sensor 10Y fixed under the first conveyance screw 8Y detects the toner concentration of the Y developer that is being conveyed. The Y developer conveyed by the first conveyance screw 8Y to the end part on the front side in the first agent container 9Y enters the second agent container 14Y via a communication port (not shown).

The second conveyance screw 11Y in the second agent container 14Y is driven by a driver (not shown) to rotate, thereby conveying the Y developer from the front side to the back side in the direction orthogonal to the surface of the drawing of FIG. 2. Above the second conveyance screw 11Y that conveys the Y developer as described above, the developing roller 12Y is disposed in a posture to be parallel to the second conveyance screw 11Y. The developing roller 12Y is configured to enclose a magnet roller 16Y that is fixed and disposed in a developing sleeve 15Y composed of a non-magnetic sleeve that is driven to rotate counterclockwise as shown in FIG. 2.

Part of the Y developer that is conveyed by the second conveyance screw 11Y is drawn up by a magnetic force emitted by the magnet roller 16Y to the surface of the developing sleeve 15Y. After the thickness of the layer of the Y developer is regulated by the doctor blade 13Y, which is disposed as keeping a predetermined gap between the doctor blade 13Y and the surface of the developing sleeve 15Y, the Y developer is conveyed to a developing area opposed to the photoconductor 3Y and then is attached to the electrostatic latent image for Y on the photoconductor 3Y. This attachment forms a Y toner image on the photoconductor 3Y. The Y developer whose Y toner is consumed for developing is returned onto the second conveyance screw 11Y according to the rotation of the developing sleeve 15Y. The Y developer conveyed by the second conveyance screw 11Y to the back end part of the second agent container 14Y as shown in FIG. 2 returns into the first agent container 9Y via the communication port (not shown). In this manner, the Y developer is circulated and conveyed in the developing unit.

The result of detection of the toner concentration of the Y developer performed by the toner concentration sensor 10Y is sent as an electric signal to a control device (not shown). The control device converts an output voltage from the toner concentration sensor 10Y in the RAM into a toner concentration of the Y developer. The control device further converts output voltages from toner concentration sensors (10C, 10M and 10K) mounted on developing units (7C, 7M and 7K) for C, M and K into toner concentrations of the respective developers (C, M and K developers). The output voltages from the toner concentration sensors composed of magnetic permeability sensors correlate with toner concentrations. As the toner concentration of a developer increases, the magnetic permeability of the developer lowers and accordingly the output value from the toner concentration sensor lowers.

The developing unit 7Y for Y compares the toner concentration detection result calculated on the basis of the output voltage from the toner concentration sensor 10Y with a control target value of the Y toner concentration stored in the RAM. To supply an amount of Y toner corresponding to the comparison result from a toner supply port 17Y, a supply motor for Y of the toner supply device is driven for a period of time corresponding to the amount of Y toner. Accordingly, in the first agent container 9Y, a proper amount of Y toner is supplied to the Y developer whose Y toner concentration has lowered due to consumption of Y toner for the development. Accordingly, the toner concentration of the Y developer in the second agent container 14Y is maintained at around the target value of the toner concentration. The same happens in the developers in the developing units 7C, 7M and 7K for other colors.

The Y toner image formed on the photoconductor 3Y shown in FIG. 1 is intermediately transferred onto an intermediate transfer belt 41 that is an intermediate transfer member. In the drum cleaning device 4Y of the photoconductor unit 2Y shown in FIG. 2, the free end of a cleaning blade 4*a*Y supported on one hand abuts the surface of the photoconductor 3Y in the counter direction. The cleaning blade 4*a*Y cleans the surface of the photoconductor 3Y by cleaning off the transfer residual toner attached to the surface of the photoconductor 3Y subjected to an intermediate transfer process. Driving a collection screw 4*b*Y of the drum cleaning device 4Y to rotate causes the cleaned-off transfer residual toner to be discharged toward the outside of the drum cleaning device 4Y. The toner then falls into a waste toner bottle (not shown). The abutment part between the blade and the photoconductor will be referred to as the "blade abutment part" below.

The surface of the photoconductor 3Y cleaned by the drum cleaning device 4Y as described above enters a counter position with respect to the lubricant application device 18Y. The lubricant application device 18Y includes an application brush roller 18*a*Y, a solid lubricant 18*b*Y, and a power spring 18*c*Y. Depending on its own power, the power spring 18*c*Y pushes the solid lubricant 18*b*Y composed of zinc stearate etc., against the application brush roller 18*a*Y. The application brush roller 18*a*Y is driven by a drive unit (not shown) to rotate in the state where the application brush roller 18*a*Y abuts both the photoconductor 3Y and the solid lubricant 18*b*Y. The application brush roller 18*a*Y then applies the lubricant powders obtained by scrubbing the solid lubricant 18*b*Y to the surface of the photoconductor 3Y. Accordingly, the surface friction coefficient of the photoconductor 3Y lowers, which improves the toner releasability with respect to the surface of the photoconductor 3Y to improve the primary transfer efficiency of the toner or reduces the surface abrasion of the photoconductor 3Y.

The surface of the photoconductor 3Y to which the lubricant powders are applied is neutralized by the neutralization device (not shown). The neutralization initializes the surface of the photoconductor 3Y to prepare for the next image formation. Similarly, in the image formation units 1C, 1M and 1K, a C tone image, a M toner image, and a K toner image are formed on the photoconductors 3C, 3M and 3K and then are intermediately transferred onto the intermediate transfer belt 41.

The optical writing unit 20 is disposed under the image formation units 1Y, 1C, 1M and 1K. The optical writing unit 20 emits a laser light L emitted according to the image information to each of the photoconductors 3Y, 3C, 3M and 3K of the respective image formation units 1Y, 1C, 1M and 1K. Accordingly, electrostatic latent images for Y, C, M and K are formed on the photoconductors 3Y, 3C, 3M and 3K.

The optical writing unit 20 emits the laser light L emitted from the light source to the photoconductors 3Y, 3C, 3M and 3K via multiple optical lenses and mirrors while deflecting the laser light L by using a polygon mirror 21 that is driven by a motor to rotate. Instead of this configuration, a configuration using an LED array may be used.

Under the optical writing unit 20, a first paper feeding cassette 31 and a second paper feeding cassette 32 are disposed as vertically overlapping with each other. In each of the paper feeding cassettes, recording sheets P serving as recording media are stored as a bulk of multiple stacked recording sheets. A first paper feeding roller 31*a* and a second paper feeding roller 32*a* abut the top recording sheets P, respectively. Once the first paper feeding roller 31*a* is driven by a driver (not shown) to rotate counterclockwise as shown in FIG. 1, the top recording sheet P in the first paper feeding cassette 31 is ejected toward a paper sheet conveyance device 33 that is disposed as extending vertically on the right side of the cassette as shown in FIG. 1. Once the second paper feeding roller 32*a* is driven by a driver (not shown) to rotate counterclockwise as shown in FIG. 1, the top recording sheet P in the second paper feeding cassette 32 is ejected toward the paper sheet conveyance device 33.

Multiple conveyance roller pairs 34 are disposed in the paper sheet conveyance device 33. A recording sheet P sent to the paper sheet conveyance device 33 is conveyed upward from the vertically lower side in the paper sheet conveyance device 33 while being sandwiched between the rollers of the conveyance roller pairs 34.

A registration roller pair 35 is disposed at the end of the paper sheet conveyance device 33. Once the registration roller pair 35 tucks the recording sheet P, which is sent from the conveyance roller pair 34, between its rollers, the registration roller pair 35 temporarily stops rotation of the rollers. The registration roller pair 35 then sends out the recording sheet P at a proper timing to a secondary transfer nip, which will be described below.

A transfer unit 40 that causes the intermediate transfer belt 41 to endlessly move counterclockwise while stretching the intermediate transfer belt 41 is disposed above the image formation units 1Y, 1C, 1M and 1K. The transfer unit 40 includes, in addition to the intermediate transfer belt 41, a belt cleaning unit 42, four primary transfer rollers 45Y, 45C, 45M and 45K, a secondary transfer backup roller 46, a drive roller 47, an assist roller 48, and a nip entry roller 49. While being stretched over these rollers, the intermediate transfer belt 41 endlessly moves counterclockwise as shown in FIG. 1 depending on the rotation drive of the driver roller 47.

The four primary transfer rollers 45Y, 45C, 45M and 45K sandwich the endlessly moving intermediate transfer belt 41 between the primary transfer rollers 45Y, 45C, 45M and 45K and the photoconductors 3Y, 3C, 3M and 3K. Accordingly, primary transfer nips for Y, M, C and K are formed where the photoconductors 3Y, 3C, 3M and 3K abut the intermediate transfer belt 41. A primary transfer bias having the inverse polarity with respect to the toner (positive polarity in the embodiment) is applied to the primary transfer rollers 45Y, 45C, 45M and 45K. In the process where the intermediate transfer belt 41 passes through the primary transfer nips for Y, C, M and K according to its endless move, the toner images of the respective colors on the photoconductors 3Y, 3C, 3M and 3K are transferred as superimposed onto the outer circumference of the intermediate transfer belt 41. In this manner, a toner image consisting of the four superimposed color images (hereinafter, "four-color toner image") is formed on the intermediate transfer belt 41.

The secondary transfer backup roller 46 tucks the intermediate transfer belt 41 between the secondary transfer backup roller 46 and a secondary transfer roller 50 that is disposed outside the loop pf the intermediate transfer belt 41. Accordingly, a secondary transfer nip where the intermediate transfer belt 41 abuts the secondary transfer roller 50 is formed. The registration roller pair 35 sends out the recording sheet P sandwiched between the rollers to the secondary transfer nip at a timing for synchronizing the recording sheet P sandwiched between the rollers with the four-color toner image on the intermediate transfer belt 41. The four-color toner image on the intermediate transfer belt 41 is secondarily transferred collectively onto the recording sheet P in the secondary transfer nip, depending on the secondary transfer electric filed formed between the secondary transfer roller 50 and the secondary transfer backup roller 46 to which a secondary transfer bias is applied and on the nip pressure. The four-color toner image and the white of the recording sheet P lead to the full-color toner image.

The transfer residual toner not transferred onto the recording sheep P is left attached on the intermediate transfer belt 41 having passed through the secondary transfer nip. The belt cleaning unit 42 cleans the transfer residual toner. The belt cleaning unit 42 scrubs the transfer residual toner on the belt to remove the transfer residual toner by using a cleaning blade 42*a* that abuts the front surface of the intermediate transfer belt 41.

To form a monochrome image, the printer causes the primary transfer rollers 45Y, 45C and 45M for Y, C and M to turn on the rotation axis of the assist roller 48 counterclockwise as shown in FIG. 1, depending on the drive from a solenoid (not shown). Accordingly, the intermediate transfer belt 41 is separated from the photoconductors 3Y, 3C and 3M for Y, C and M. Thereafter, only the image formation unit 1K for K from among the four image formation units 1Y, 1C, 1M and 1K is driven to form a monochrome image. In this manner, it is possible to prevent wear of the image formation units for Y, C and M resulting from uselessly driving the image formation units for Y, C and M r when a monochrome image is formed.

A fixing unit 60 serving as a fixing unit is disposed above the secondary transfer nip as shown in FIG. 1. The fixing unit 60 includes a pressure-heat roller 61 that encloses a heat source, such as a halogen lamp, and a fixing belt unit 62. The fixing belt unit 62 includes a fixing belt 64, a heat roller 63 that encloses a heat source, such as a halogen lamp, a tension roller 65, a drive roller 66, and a temperature sensor (not shown). The endless fixing belt 64 is caused to endlessly move counterclockwise as shown in FIG. 2 while being stretched by the heat roller 63, the tension roller 65 and the drive roller 66. During the endless move process, the fixing belt 64 is heated by the heat roller 63 from the back surface.

The pressure-heat roller 61 that is driven to rotate clockwise as shown in FIG. 1 abuts the front surface of the fixing belt 64 in the part where the fixing belt 64 is laid over the heat roller 63. Accordingly, a fixing nip where the pressure-heat roller 61 and the fixing belt 64 abut is formed.

Outside the loop of the fixing belt 64, the temperature sensor (not shown) is disposed as opposed to the front surface of the fixing belt 64 with a predetermined gap in between. The temperature sensor detects the surface temperature of the fixing belt 64 just before entering the fixing nip. The result of the detection is sent to a fixing power supply circuit (not shown). According to the result of the detection performed by the temperature sensor, the fixing power supply circuit performs on/off control on the power supply to the heat source enclosed in the heat roller 63 and the heat source enclosed in the pressure-heat roller 61. Accordingly, the surface temperature of the fixing belt 64 is maintained at approximately 140° C.

The recording sheet P having passed through the secondary transfer nip is separated from the intermediate transfer belt 41 and then sent into the fixing unit 60. In the process where the recording sheet P is conveyed upward from the lower side as shown in FIG. 1 while being tucked in the fixing nip in the fixing unit 60, the recording sheet P is heated or pressed by the fixing belt 64, so that the full-color toner image is fixed onto the recording sheet P.

The recording sheet P subjected to the fixing processing passes between the rollers of a paper ejection roller pair 67 and is then ejected to the outside of the apparatus. A stack unit 68 is formed on the top surface of the casing of the printer main unit. Recording sheets P ejected by the ejection roller pair 67 to the outside of the apparatus are sequentially stacked on the stack unit 68.

Four toner bottles 72Y, 72C, 72M and 72K that are toner storages that store the Y, C, M and K toners, respectively, are disposed above the transfer unit 40. The toner supply device properly supplies the toners of the respective colors in the toner bottles 72Y, 72C, 72M and 72K to the developing units 7Y, 7C, 7M and 7K of the image formation units 1Y, 1C, 1M and 1K. The toner bottles 72Y, 72C, 72M and 72K can be attached to/detached from the printer main unit independently of the image forming units 1Y, 1C, 1M and 1K.

Figure 3:
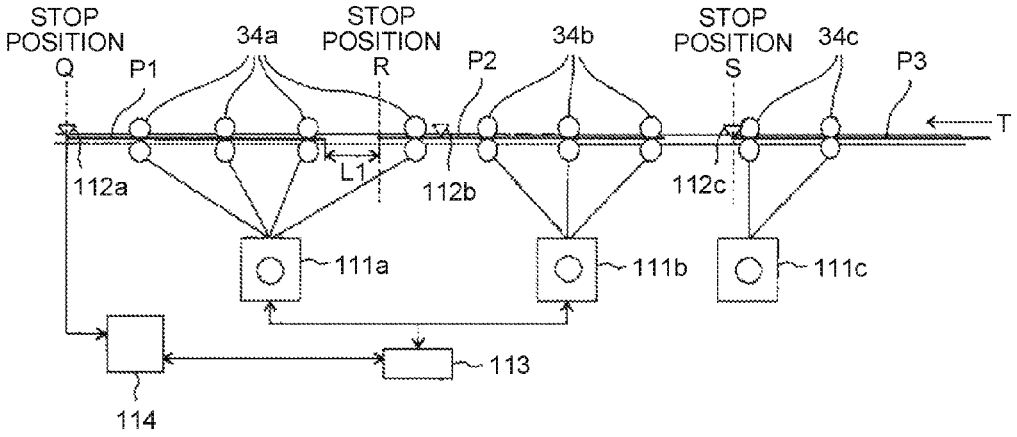
FIG. 3 is a diagram of an exemplary schematic configuration of a paper sheet conveyance device of the printer.

FIG. 3 is a diagram of an exemplary schematic configuration of the paper sheet conveyance device 33.

As shown in FIG. 3, the paper sheet conveyance device 33 includes conveyance roller pairs 34*a*, 34*b* and 34*c* and sensors 112*a*, 112*b* and 112*c*. The paper sheet conveyance device 33 further includes a controller 113 and a time measuring unit 114. The conveyance roller pair 34*a* is driven by a drive motor 111*a*, the conveyance roller pair 34*b* is driven by a drive motor 111*b*, and the conveyance roller pair 34*c* is driven by a drive motor 111*c*.

According to FIG. 3, each of the conveyance roller pairs 34*a*, 34*b* and 34*c* is composed of multiple pairs of rollers. Alternatively, each of the conveyance roller pairs 34*a*, 34*b* and 34*c* may be composed of a pair of rollers. While increasing the number of roller pairs enables more stable paper sheet conveyance, increasing the number of parts may increase the cost of the device and increase the power consumption. For this reason, even when the number of roller pairs is increased, the roller pairs are configured to be driven by one drive motor to prevent the device cost and the power consumption from increasing.

The sensors 112*a*, 112*b* and 112*c* are disposed on the downstream side with respect to the conveyance roller pairs 34*a*, 34*b* and 34*c*, at which the paper sheets are detected, in the direction in which paper sheets are conveyed (denoted by the arrow T shown in FIG. 3). On the conveyance path, multiple stop positions Q, R and S are provided at which the conveyed paper sheets are temporarily stopped.

In order to increase the productivity of the printer, the paper sheet conveyance device 33 has to supply paper sheets at short intervals. When paper sheets are supplied at short intervals, the interval between paper sheets (paper sheet interval) during conveyance shortens. If the paper sheet interval is shortened in the case where the conveyance roller pairs 34*a*, 34*b* and 34*c* shown in FIG. 3 are configured to be driven by one drive motor, when the leading edge of the paper sheet P1 reaches a stop position Q, the leading edge of a paper sheet P2 is tucked by the conveyance roller pair 34*a* that is driven by a drive motor 111*a* (the leading edge of the paper sheet P reaches the stop position R).

The drive motor 111*a* is stopped in order to stop the leading edge of the paper sheet P1 at the stop position Q. When the drive motor 111*a* is stopped, if the drive motor 111*a* is not stopped simultaneously, only the leading edge of the paper sheet P2 tucked by the conveyance roller pair 34*a* stops and the remaining part of the paper sheet P2 is conveyed by the conveyance roller pair 34*b*, so that the paper sheet P loosens. For this reason, when the paper sheet P1 is stopped at the stop position Q, it is required to stop not only the drive motor 111*a* but also the drive motor 111*b*. When the conveyance roller pair 34*a* and the conveyance roller pair 34*b* have the same conveyance rate, the distance between the stop position Q and the stop position R and the distance between the stop position R and the stop position S have to be equalized in order to synchronously drive and stop the drive motor 111*a* and the drive motor 111*b*.

When the leading edge of the paper sheet P1 is stopped at the stop position Q as shown in FIG. 3, the leading edge of the paper sheet P3 is at the stop position S. Because the paper sheet P3 is tucked only by the conveyance roller pair 34*c*, it is unnecessary to synchronize the drive motor 111*c* with the driver motors 111*a* and 111*b*.

An inconvenience caused when a delay of the top paper sheet P1 occurs due to, for example, a slip occurring during conveyance or a software delay will be described below.

Figure 4:
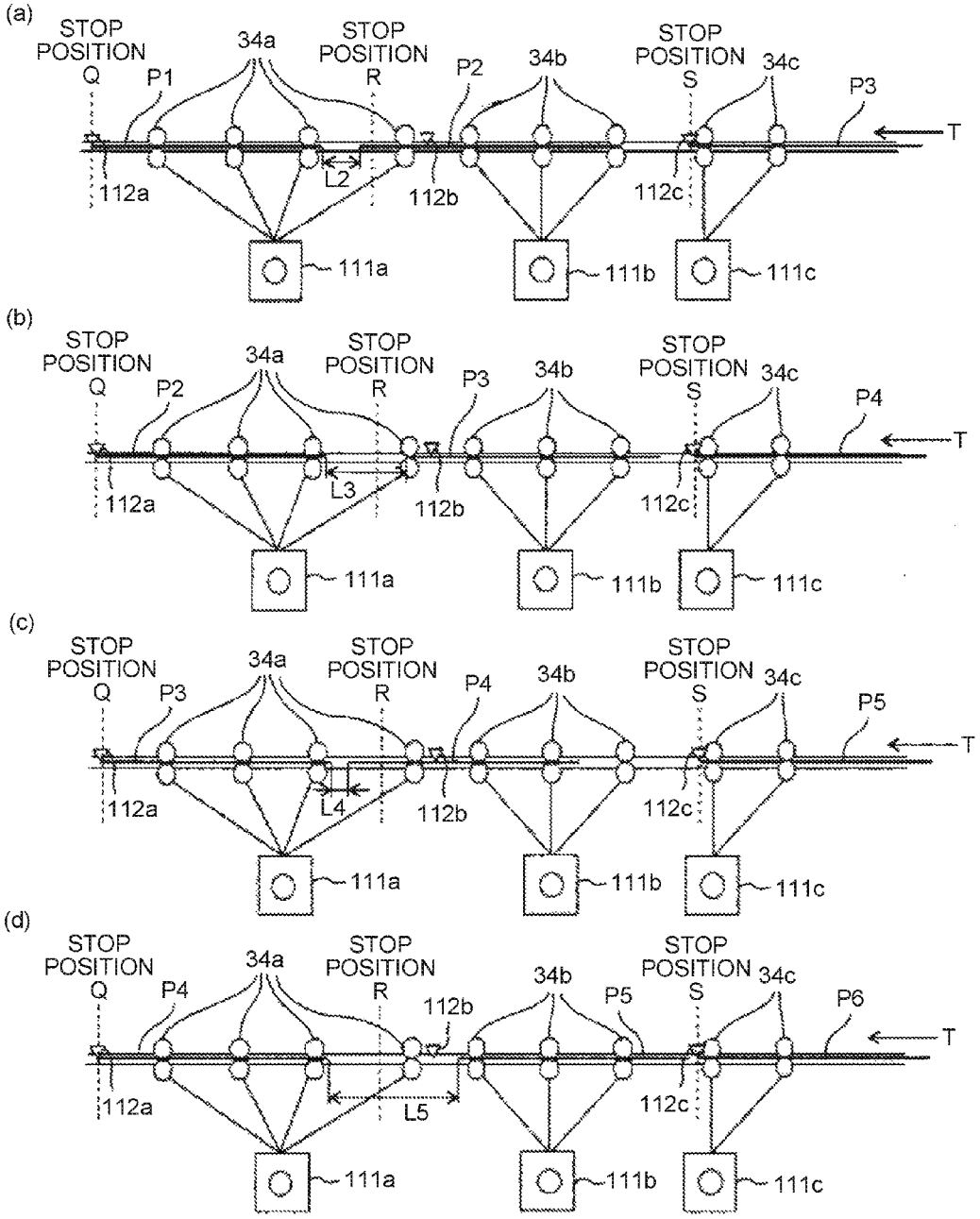
FIG. 4 is a diagram illustrating an inconvenience caused when a delay of the top paper sheet occurs during conveyance in the paper sheet conveyance device.

FIG. 4 is diagram illustrating an inconvenience caused when a delay of the top paper sheet P1 occurs due to, for example, a slip occurring during conveyance or a software delay.

When a delay of the paper sheet P1 occurs, the interval between the paper sheet P1 and the paper sheet P2 is shorter than that in the case where no delay occurs. For this reason, as shown in FIG. 4(*a*), when the leading edge of the paper sheet P1 reaches the stop position Q, the leading edge of the paper sheet P2 reaches a position beyond the stop position R. As shown in FIG. 4(*a*), when the sensor 112*a* detects the leading edge of the paper sheet P1 and the drive motor 111*a* and the drive motor 111*b* are stopped, the paper sheet interval L2 between the paper sheet P1 and the paper sheet P2 is shorter than an expected paper sheet interval L (L2<L1) (see FIG. 3). The expected paper sheet interval L1 is the paper interval between the preceding paper sheet and the following paper sheet obtained when the leading edge of the preceding paper sheet stops at the stop position Q and the leading edge of the following paper sheet stops at the stop position R.

After the leading edge of the paper sheet P1 is stopped at the stop position Q, the drive motor 111*a* and the drive motor 111*b* are driven to restart conveying the paper sheets. As described above, the drive motor 111*c* is not synchronized with the drive motor 111*a* and the drive motor 111*b*. The drive motor 111*c* is stopped such that the leading edge of the paper sheet P3 stops at the stop position S just before conveying the paper sheets is restarted. After conveying the paper sheets is restarted, the distance the leading edge of the paper sheet P2 moves to reach the stop position Q is shorter than the distance between the stop position Q and the stop position R in accordance with the distance by which the position at which the paper sheet P2 stops is beyond the stop position R.

While the leading edge of the paper sheet P2 moves from the position beyond the stop position R to the stop position Q, the leading edge of the paper sheet P3 moves the same distance from the stop position S as that the leading edge of the paper sheet P2 moves. When the leading edge of the paper sheet P2 is stopped at the stop position Q, the leading edge of the paper sheet P3 stops at a position before the stop position R as shown in FIG. 4(*b*). Accordingly, the paper sheet interval L3 between the paper sheet P2 and the paper sheet P3 is longer than the expected paper sheet interval L1 (L3>L1) (see FIG. 3).

After conveying the paper sheets is restarted, the distance the leading edge of the paper sheet P3 moves to reach the stop position Q is longer than the distance between the stop position Q and the stop position R in accordance with the distance by which the position at which the leading edge of the paper sheet P3 stops is before the stop position R. While the leading edge of the paper sheet P3 moves from the position before the stop position R to the stop position Q, the leading edge of the paper sheet P4 moves the same distance from the stop position S as that the leading edge of the paper sheet P3 moves. When the leading edge of the paper sheet P3 is stopped at the stop position Q, the leading edge of the paper sheet P4 stops at a position beyond the stop position R as shown in FIG. 4(*c*). The paper sheet interval L4 between the paper sheet P3 and the paper sheet P4 is further shorter than the paper sheet interval L2 between the paper sheet P1 and the paper sheet P2 shown in FIG. 4(*a*) (L4<L2).

After conveying the paper sheets is restarted, the distance the leading edge of the paper sheet 4 moves to reach the stop position Q is shorter than the distance between the stop position Q and the stop portion R in accordance with the distance by which the position at which the leading edge of the paper sheet P4 stops is beyond the stop position R. While the leading edge of the paper sheet P4 moves from the position beyond the stop position R to the stop position Q, the leading edge of a paper sheet P5 moves the same distance from the stop position S as that the leading edge of the paper sheet P4 moves. When the leading edge of the paper sheet P4 is stopped at the stop position Q, the leading edge of the paper sheet P5 stops at a position before the stop position R as shown in FIG. 4(*d*). The paper sheet interval L5 between the paper sheet P4 and the paper sheet P5 is further shorter than the paper sheet interval L3 between the paper sheet P1 and the paper sheet P2 shown in FIG. 4(*b*) (L5>L4).

As described above, a delay of the top paper causes a deviation of the paper sheet interval between the top paper sheet and the following paper sheet from the expected paper sheet interval and the deviation is amplified as conveying the paper sheets is repeated. Accordingly, the paper sheet interval cannot be secured finally, which may lead to an inconvenience, such as paper jam.

The inconvenience caused when a delay of the top paper sheet P1 occurs has been described with reference to FIG. 4.

An inconvenience occurs also when the top paper sheet P1 is normal but a delay of the paper sheet P2 following the paper sheet P1 occurs.

Figure 5:
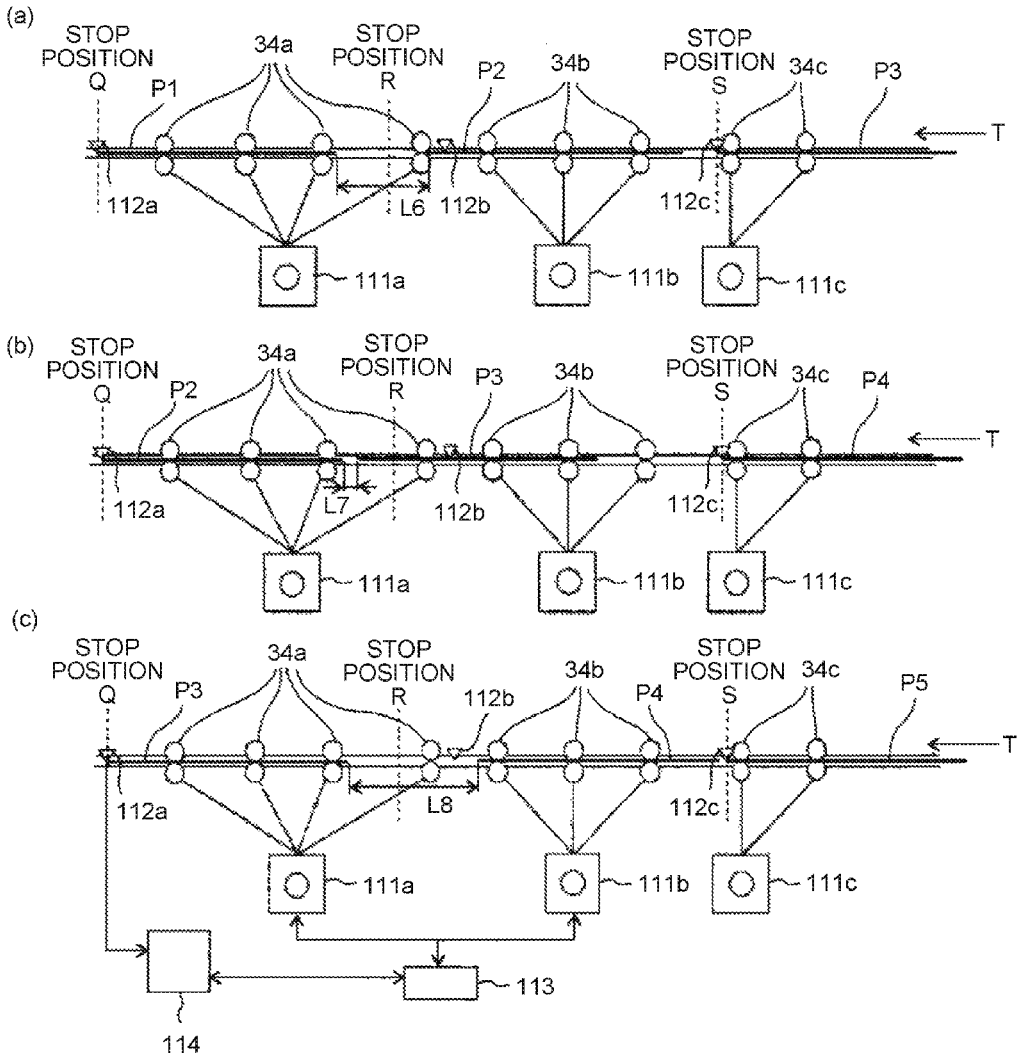
FIG. 5 is a diagram illustrating an inconvenience caused when a delay of the paper sheet following the top paper sheet occurs during conveyance in the paper sheet conveyance device.

FIG. 5 is a diagram illustrating an inconvenience caused when there is a delay of the paper sheet P2 due to a slip during conveyance or a software delay.

When a delay of the paper sheet P2 occurs, the delay between the paper sheet P1 and the paper sheet P2 is longer than that obtained when no delay occurs. For this reason, when the leading edge of the paper sheet P1 reaches the stop position Q as shown in FIG. 5(*a*), the leading edge of the paper sheet P2 is at a position before the stop position R. As shown in FIG. 5(*a*), when the drive motor 111*a* and the drive motor 111*b* are stopped, the interval L6 between the paper sheet P1 and the paper sheet P2 is longer than the expected paper sheet interval L1 (see FIG. 3) (L5>L1).

After the leading edge of the paper sheet P1 is stopped at the stop position Q, the drive motor 111*a* and the drive motor 111*b* are driven to restart conveying the paper sheets. As described above, the drive motor 111*c* is not synchronized with the drive motor 111*a* and the drive motor 111*b*. The drive motor 111*c* is stopped such that the leading edge of the paper sheet P3 stops at the stop position S. After conveying the paper sheets is restarted, the distance the leading edge of the paper sheet P2 moves to reach the stop position Q is longer than the distance between the stop position Q and the stop position R in accordance with the distance by which the position at which the paper sheet P2 stops is before the stop position R.

While the leading edge of the paper sheet P2 is moves from the position before the stop position R, the leading edge of the paper sheet P3 moves the same distance from the stop position S as that the leading edge of the paper sheet P2 moves. When the leading edge of the paper sheet P2 is stopped at the stop position Q, the leading edge of the paper sheet P3 stops at a position beyond the stop position R as shown in FIG. 5(*b*). Accordingly, the paper sheet interval L7 between the paper sheet P2 and the paper sheet P3 is shorter than the expected paper sheet interval L1 (L7<L1) (see FIG. 3).

After conveying the paper sheets is restarted, the distance the leading edge of the paper sheet P3 moves to reach the stop position Q is shorter than the distance between the stop position Q and the stop position R in accordance with the distance by which the position at which the leading edge of the paper sheet P3 stops is beyond the stop position R. While the leading edge of the paper sheet P3 moves from the position beyond the stop position R to the stop position Q, the leading edge of the paper sheet P4 moves the same distance from the stop position S as that the leading edge of the paper sheet P3 moves. When the leading edge of the paper sheet P3 is stopped at the stop position Q, the leading edge of the paper sheet P4 stops at a position before the stop position R as shown in FIG. 5(*c*). The paper sheet interval L8 between the paper sheet P3 and the paper sheet P4 is further longer than the paper sheet interval L6 between the paper sheet P1 and the paper sheet P2 shown in FIG. 5(*a*) (L8>L6).

As described above, a delay of the paper sheet following the top paper sheet causes a deviation of the paper sheet interval between the top paper sheet and the following paper sheet from the expected paper sheet interval and the deviation is amplified as conveying the paper sheets is repeated. Accordingly, the paper sheet interval cannot be secured finally, which may lead to an inconvenience, such as paper jam.

Control for correcting the paper sheet interval when there a delay occurs due to a slip during conveyance or a software delay, which is a characteristic of the embodiment, will be described below.

Figure 6:
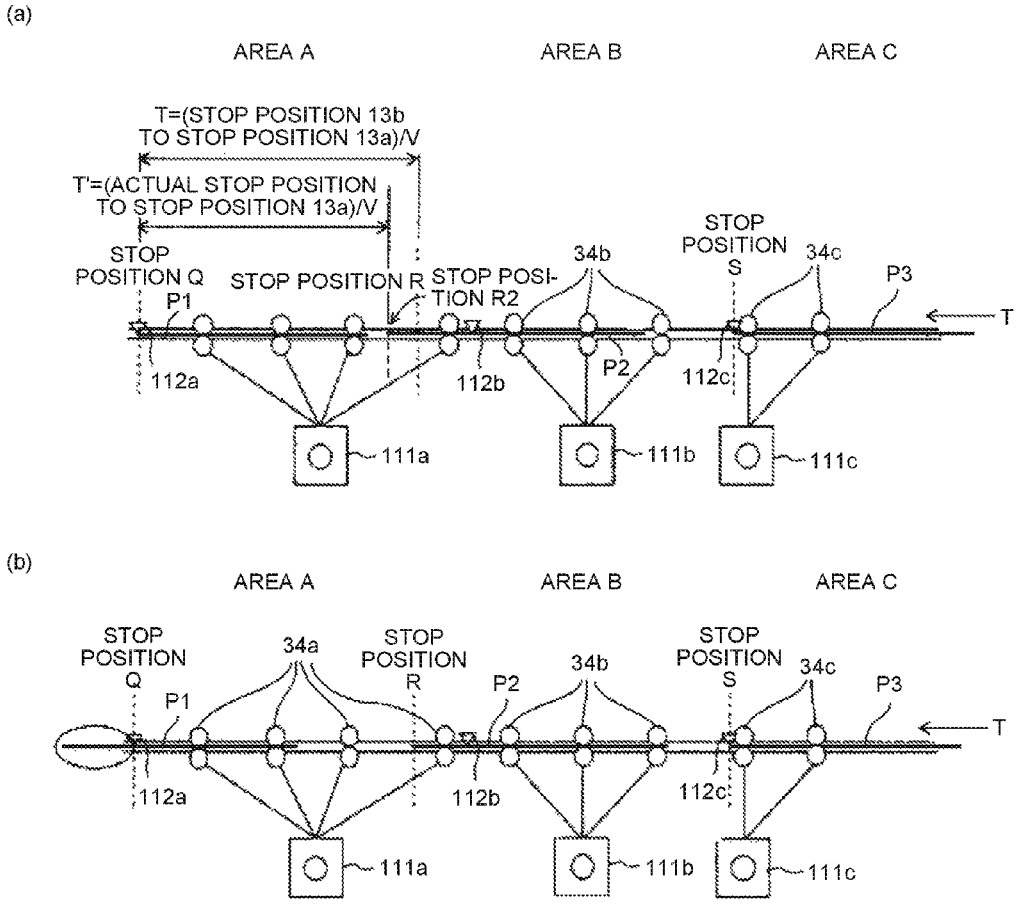
FIG. 6 is a diagram illustrating control for correcting the interval between the paper sheets when a delay in conveying the paper sheets occurs during conveyance.

FIG. 6 is a diagram illustrating control for correcting the paper sheet interval when a delay occurs due to a slip during conveyance or a software delay.

The time required for the leading edge of a paper sheet to move from the stop position R to the stop position Q is taken as an ideal move time T (for example, 250 [ms]). The ideal move time T is obtained by dividing the distance between the stop position Q and the stop position R by a paper sheet conveyance rate V (T=(distance between stop position Q and stop position R)/V).

The time required for a paper sheet to move from the stop position R2 where the paper sheet actually stops to the stop position Q is taken as an actual move time T'. The actual move time T' is obtained by dividing the distance between the stop position Q and a stop position R2 by the paper sheet conveyance rate V (T'=(distance between stop position Q and stop position R2)/V). The actual move time T' can be acquired by the time measuring unit 114 by measuring the time required for the sensor 112*a* to detect the leading edge of the paper sheet P2 from when the paper sheet P2 stops at the stop position R2 and the conveying is restarted.

As shown in FIG. 6(*a*), when a delay of the paper sheet P1 occurs, the interval between the paper sheet P1 and the paper sheet P2 is shorter than the specific paper sheet interval. For this reason, the actual move time T' is shorter than the ideal move time T. As long as the difference between ideal move time T and the actual move time T' is small enough, there is no practical problem even if the paper sheet interval is not corrected. However, when the difference between the ideal move time T and the actual move time T' exceeds a certain value (for example, 50 [ms]), the deviation of the paper sheet interval between the top paper sheet and the following paper sheet from the expected paper sheet interval is amplified as described with FIG. 4. Accordingly, the paper sheet interval cannot be secured finally, which may lead to an inconvenience, such as paper jam.

According to FIG. 6(*b*), when the actual move time is equal to or smaller than a certain threshold (for example, 200 [ms]), the controller 113 controls the drive motors 111*a* and 111*b* such that the leading edge of the paper sheet P2 reaches a position beyond the stop position Q by a specific distance. The paper sheet P3 is thus conveyed to be close to a stop position 13*b* and accordingly the paper sheet interval between the following paper sheets (the paper sheet P3 and the paper sheet P4) is corrected to prevent occurrence of an inconvenience, such as paper jam. The sensor 112*b* disposed at a point just before the stop position R is not used for the control described above, but it can be used to, for example, specify the position of a jammed paper sheet. The sensor 112*c* disposed at the stop position S is used to stop the drive motor 111*c* in a state where the paper sheet leading edge is at the stop position S.

As for the paper sheet conveyance device disclosed in Japanese Laid-open Patent Publication No. 2012-180189, it is necessary to increase the number of drive units for driving the conveyance roller pairs in order to separately drive and stop the conveyance roller pair that conveys a preceding paper sheet and a conveyance roller pair that conveys a paper sheet following the preceding paper sheet. For this reason, there is a risk that the device cost may significantly increase. On the other hand, the paper sheet conveyance device according to the embodiments is capable of correcting the deviation in the paper sheet interval even when a preceding paper sheet and a paper sheet following the preceding paper sheet are conveyed by conveyance roller pairs that are driven by the same drive source.

The above-described embodiment is an example only. The present invention causes effects unique to the following various modes.

Mode A

A paper sheet conveyance device that conveys a paper sheet while temporarily stopping the conveying and then restarting the conveying, the device including a plurality of conveyance members, such as the conveyance roller pairs 34, that are disposed along a conveyance path for paper sheet and that are driven in order to convey the paper sheet, wherein two paper sheets sequential in a conveyance direction stop together in a temporary stop state where the conveying is temporarily stopped, driving a first transfer member to which a preceding first paper sheet that is one of the two paper sheets is opposed and a second conveyance member to which a following second paper sheet that is the other paper sheet is opposed is stopped and restarted synchronously in order to temporarily stop and restart the conveying, a stop position information acquisition unit, such as the time measuring unit 114, is disposed that acquires information on a position on the conveyance path at which the second paper sheet stops in the temporary stop state, and a timing for stopping the conveying after the conveying is restarted is controlled according to the information acquired by the stop position information acquisition unit.

When a delay occurs in conveying the first paper sheet during conveyance preceding the temporary stop state, the interval between the first paper sheet and the second paper sheet shortens and the position at which the second paper sheet stops as opposed to the second conveyance member in the temporary stop state is a position shifted from the ideal stop position to the downstream side. Information on the actual stop position is obtained by the stop position information acquisition unit. For example, the stop position information acquisition unit may be configured to, according to the elapsed time from the time point at which the conveying is restarted after the conveying is temporarily stopped to the time point at which the second paper sheet is detected by a paper sheet detection unit disposed in a predetermined position, obtain the position of the second paper sheet at the first time point.

When the conveying is stopped after restarted, the second paper sheet is opposed to the first conveyance member and a third paper sheet following the second paper sheet is opposed to the second conveyance member. The timing at which the second paper sheet stops as opposed to the first conveyance member is controlled according to the information obtained by the stop position information acquisition unit. Specifically, because the information is on the actual position at which the second paper sheet stops as opposed to the second conveyance member, the actual stop position is calculated by comparing the elapsed time with the time required for the second paper sheet to be conveyed from the ideal stop position opposed to the first conveyance member to the ideal stop position opposed to the second conveyance member (ideal time). If the calculated actual stop position shifts from the ideal position at which the second paper stops as opposed to the second conveyance member to the downstream side, the elapsed time is shorter than the ideal time. On the other hand, if the calculated actual stop position shifts from the ideal stop position at which the second paper stops as opposed to the second conveyance member to the upstream side, the elapsed time is longer than the ideal time.

Logically, setting a position at which the second paper sheet stops as opposed to the first conveyance member in accordance with the actual position at which the second paper sheet stops as opposed to the second conveyance member, which is the position calculated by using the elapsed time, enables the position at which the third paper sheet stops as opposed to the second conveyance unit to be an ideal stop position. Specifically, the position at which the second paper sheet stops as opposed to the first conveyance member is shifted from the ideal stop position in accordance with the shift of the actual position where the second paper sheet stops as opposed to the second conveyance member from the ideal stop position. Accordingly, the third paper sheet can be stopped at the ideal position opposed to the second conveyance member and thus the interval between the third paper sheet and the following fourth paper sheet can be an ideal one.

However, a delay of the second paper sheet may occur while the elapsed time is being measured. In such a case, it is not possible to strictly calculate the actual position at which the second paper sheet stops as opposed to the second conveyance member. If the calculated actual stop position is not strict, the position at which the third paper sheet stops as opposed to the second conveyance member cannot be the ideal stop position. Accordingly, the interval between the third paper sheet and the fourth paper sheet cannot be an ideal interval. For this reason, the calculated approximate stop position is used as an indication to determine whether to correct the interval between the third paper sheet and the fourth paper sheet. For example, only when the calculated approximate stop position shifts from the ideal position at which the second paper sheet stops as opposed to the second conveyance member to the downstream side by a given distance or more, the actual position at which the second paper sheet stops as opposed to the first conveyance member is shifted by the given distance from the ideal stop position. Alternatively, for example, only when the calculated approximate stop position shifts from the ideal position at which the second paper sheet stops as opposed to the second conveyance member to the upstream side by a given distance or more, the actual position at which the second paper sheet stops as opposed to the first conveyance member is shifted by the given distance from the ideal stop position. Alternatively, for example, only when the calculated approximate stop position shifts from the ideal position at which the second paper sheet stops as opposed to the second conveyance member to the upstream or downstream side by a given distance or more, the actual position at which the second paper sheet stops as opposed to the first conveyance member is shifted by the given distance from the ideal stop position. In this manner, the actual position at which the third paper sheet stops as opposed to the second conveyance member can be made close to the ideal stop position, and the interval between the third paper sheet and the following fourth paper sheet can be corrected to be close to the ideal interval.

Synchronously driving and stopping the first conveyance member and the second conveyance member simplify the control on driving and stopping the conveyance member, compared to the case where the first conveyance member and the second conveyance member are driven and stopped separately, which prevents an increase of cost in the device.

Mode B

According to Mode A, the conveying is temporarily stopped by using the result of detection performed by a paper sheet detection unit, such as the sensor 112*a*, that is disposed in a predetermined position on the conveyance path.

Mode C

According to Mode A or B, the stop position information acquisition unit acquires the stop position information by using a timing at which the paper sheet detection unit detects the second paper sheet after the conveying is restarted.

Mode D

According to any one of Modes A to C, the conveying is temporarily stopped by using the result of detection of the first paper sheet that is performed by the paper sheet detection unit.

Mode E

According to any one of Modes A to D, a third conveyance member that can be driven and controlled separately from the first conveyance member and the second conveyance member is disposed on an upstream side with respect to the second conveyance member in the conveyance direction.

According to the embodiments, it is possible to prevent multiple paper feeding and paper jam due to the interval too much shortened between the preceding paper sheet and the following paper sheet being conveyed, while preventing an increase of device cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper sheet conveyance device, comprising:

a plurality of conveyance members disposed along a conveyance path for a paper sheet;

a drive motor operatively connected to the plurality of conveyance members; and a controller configured to execute computer-readable instructions such that the controller is configured to perform operations preventing overlap of sequential sheets including, driving the plurality of conveyance members in order to convey the paper sheet, and conveying the paper sheet while performing temporary stop of conveying the paper sheet and then restart of conveying the paper sheet, maintaining an interval between two paper sheets that are spaced apart in a conveyance direction and sequential in the conveyance direction, that stop together in a state of the temporary stop of conveying, driving a first conveyance member to which a preceding first paper sheet that is one of the two paper sheets is opposed while temporarily stopping a second conveyance member to which a following second paper sheet that is the other paper sheet is opposed and restarting the second conveyance member during the driving of the first conveyance member, acquiring stop position information on a position on the conveyance path at which the second paper sheet stops in the state of the temporary stop of conveying, and controlling, according to the acquired stop position information, a timing for stopping of the second conveyance member after the conveying of the second paper sheet is restarted.

2. The paper sheet conveyance device according to claim 1, wherein the temporary stop of conveying is performed by using a result of detection performed by a paper sheet sensor disposed in a predetermined position on the conveyance path.

3. The paper sheet conveyance device according to claim 2, wherein the controller is further configured to acquire the stop position information by using a timing at which the paper sheet sensor detects the second paper sheet after the conveying is restarted.

4. The paper sheet conveyance device according to claim 3, wherein the temporary stop of conveying is performed by using a result of detection of the first paper sheet that is performed by the paper sheet sensor.

5. The paper sheet conveyance device according to claim 4, wherein a third conveyance member that can be driven and controlled separately from the first conveyance member and the second conveyance member is disposed on an upstream side with respect to the second conveyance member in the conveyance direction.

6. The paper sheet conveyance device according to claim 3, wherein a third conveyance member that can be driven and controlled separately from the first conveyance member and the second conveyance member is disposed on an upstream side with respect to the second conveyance member in the conveyance direction.

7. The paper sheet conveyance device according to claim 2, wherein the temporary stop of conveying is performed by using a result of detection of the first paper sheet that is performed by the paper sheet sensor.

8. The paper sheet conveyance device according to claim 7, wherein a third conveyance member that can be driven and controlled separately from the first conveyance member and the second conveyance member is disposed on an upstream side with respect to the second conveyance member in the conveyance direction.

9. The paper sheet conveyance device according to claim 2, wherein a third conveyance member that can be driven and controlled separately from the first conveyance member and the second conveyance member is disposed on an upstream side with respect to the second conveyance member in the conveyance direction.

10. The paper sheet conveyance device according to claim 1, wherein the controller is further configured to acquire the stop position information by using a timing at which a paper sheet sensor detects the second paper sheet after the conveying is restarted.

11. The paper sheet conveyance device according to claim 10, wherein the temporary stop of conveying is performed by using a result of detection of the first paper sheet that is performed by the paper sheet sensor.

12. The paper sheet conveyance device according to claim 11, wherein a third conveyance member that can be driven and controlled separately from the first conveyance member and the second conveyance member is disposed on an upstream side with respect to the second conveyance member in the conveyance direction.

13. The paper sheet conveyance device according to claim 10, wherein a third conveyance member that can be driven and controlled separately from the first conveyance member and the second conveyance member is disposed on an upstream side with respect to the second conveyance member in the conveyance direction.

14. The paper sheet conveyance device according to claim 1, wherein the temporary stop of conveying is performed by using a result of detection of the first paper sheet that is performed by a paper sheet sensor.

15. The paper sheet conveyance device according to claim 14, wherein a third conveyance member that can be driven and controlled separately from the first conveyance member and the second conveyance member is disposed on an upstream side with respect to the second conveyance member in the conveyance direction.

16. The paper sheet conveyance device according to claim 1, wherein a third conveyance member that can be driven and controlled separately from the first conveyance member and the second conveyance member is disposed on an upstream side with respect to the second conveyance member in the conveyance direction.

17. An image forming apparatus comprising:

an image forming unit that forms an image on a paper sheet; and a paper sheet conveyance device including a plurality of conveyance members disposed along a conveyance path for a paper sheet; and a controller configured to execute computer-readable instructions such that the controller is configured to perform preventing overlap of sequential sheets, driving the plurality of conveyance members in order to convey the paper sheet, and conveying the paper sheet while performing temporary stop of conveying the paper sheet and then restart of conveying the paper sheet, maintaining an interval between two paper sheets that are spaced apart in a conveyance direction and sequential in the conveyance direction, that stop together in a state of the temporary stop of conveying, driving a conveyance member to which a preceding first paper sheet that is one of the two paper sheets is opposed while temporarily stopping a second conveyance member to which a following second paper sheet that is the other paper sheet is opposed and restarting the second conveyance member during the driving of the first conveyance member, acquiring information on a position on the conveyance path at which the second paper sheet stops in the state of the temporary stop of conveying, and controlling, according to the information acquired, a timing for the stopping of the second conveyance member after the conveying of the second paper sheet is restarted.

* * * * *